US011795949B2

(12) United States Patent
Morita et al.

(10) Patent No.: US 11,795,949 B2
(45) Date of Patent: Oct. 24, 2023

(54) LIQUID LEVEL HEIGHT DETECTION IN A GAS-LIQUID SEPARATOR OF A LIQUID SUPPLY TYPE GAS COMPRESSOR

(71) Applicant: Hitachi Industrial Equipment Systems Co., Ltd., Tokyo (JP)

(72) Inventors: Kenji Morita, Tokyo (JP); Masahiko Takano, Tokyo (JP); Shigeyuki Yorikane, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 399 days.

(21) Appl. No.: 17/280,693

(22) PCT Filed: Mar. 26, 2019

(86) PCT No.: PCT/JP2019/012698
§ 371 (c)(1),
(2) Date: Mar. 26, 2021

(87) PCT Pub. No.: WO2020/070910
PCT Pub. Date: Apr. 9, 2020

(65) Prior Publication Data

US 2022/0003236 A1 Jan. 6, 2022

(30) Foreign Application Priority Data

Oct. 3, 2018 (JP) ..... 2018-187887

(51) Int. Cl.
*F04C 29/00* (2006.01)
*F04C 29/02* (2006.01)
*F25B 13/00* (2006.01)

(52) U.S. Cl.
CPC ..... *F04C 29/0014* (2013.01); *F04C 29/026* (2013.01); *F25B 13/00* (2013.01)

(58) Field of Classification Search
CPC ..... F04B 39/02; F04B 39/04; F25B 13/00; F25B 41/20; F25B 49/02; F25B 2400/23;
(Continued)

(56) References Cited

U.S. PATENT DOCUMENTS

2006/0018763 A1 1/2006 Uratani
2009/0087320 A1 4/2009 Tanaka et al.

FOREIGN PATENT DOCUMENTS

CN 1724867 A 1/2006
CN 106196771 A * 12/2016
(Continued)

OTHER PUBLICATIONS

CN-111536718-B, translation (Year: 2023).*
(Continued)

*Primary Examiner* — J. Todd Newton
(74) *Attorney, Agent, or Firm* — Crowell & Moring LLP

(57) ABSTRACT

The liquid level of a liquid supply compressor including a gas-liquid separator is dynamically monitored. A liquid supply gas compressor includes a compressor body; a gas-liquid separator separates liquid from compressed gas, to store the liquid; a liquid piping system supplies liquid stored to the compressor body; an internal pipe extends in an internal space of the gas-liquid separator, and includes at least two hole portions, with different disposition positions in a height direction, on an internal side to communicate with the piping system; and a sensor detecting pressure or temperature of fluid flowing through the piping system.

19 Claims, 8 Drawing Sheets

(58) Field of Classification Search
CPC .... F25B 9/004; F04C 29/0014; F04C 29/026; F04C 18/16; F04C 29/021; F04C 2240/81; F04C 2270/24
USPC ..... 418/84
See application file for complete search history.

(56) References Cited

FOREIGN PATENT DOCUMENTS

| | | | | | |
|---|---|---|---|---|---|
| CN | 111536718 | B | * | 11/2021 | ..... F25B 31/004 |
| JP | 55-4325 | U | | 1/1980 | |
| JP | 56-127883 | U | | 9/1981 | |
| JP | 2009-74523 | A | | 4/2009 | |
| JP | 2009-85045 | A | | 4/2009 | |

OTHER PUBLICATIONS

CN-106196771-A, translation (Year: 2023).*
International Search Report (PCT/ISA/210) issued in PCT Application No. PCT/JP2019/012698 dated Jul. 16, 2019 with English translation (five (5) pages).
Japanese-language Written Opinion (PCT/ISA/237) issued in PCT Application No. PCT/JP2019/012698 dated Jul. 16, 2019 with partial English translation (16 pages).
Chinese-language Office Action issued in Chinese Application No. 201980062721.6 dated May 24, 2022 with English translation (20 pages).

* cited by examiner

A-A CROSS SECTION

B ARROW VIEW

TENDENCY 1:
COUNTER NUMBER DECREASES
AS ROTATION SPEED INCREASES

TENDENCY 2:
COUNTER NUMBER INCREASES
AS ROTATION SPEED INCREASES

TENDENCY 3:
COUNTER NUMBER CHANGES
CONVEXLY ACCORDING
TO ROTATION SPEED

TENDENCY 4:
COUNTER NUMBER CHANGES
CONCAVELY ACCORDING
TO ROTATION SPEED

LIQUID LEVEL HEIGHT DETECTION IN A GAS-LIQUID SEPARATOR OF A LIQUID SUPPLY TYPE GAS COMPRESSOR

TECHNICAL FIELD

The present invention relates to a liquid supply type gas compressor including a gas-liquid separator, and a liquid supply type gas compressor, and to the structure of a liquid supply type gas compressor and a gas-liquid separator that detect a liquid level height in the gas-liquid separator.

BACKGROUND ART

For example, an oil supply type air compressor which is one of liquid supply type gas compressors includes a compressor body, an oil separator, and an oil piping system (for example, refer to Patent Document 1). The compressor body compresses a gas such as air while injecting an oil (liquid) to a compression chamber for the purpose of cooling compression heat, lubricating a compression member such as a rotor or a wrap, sealing the compression chamber, and the like. The oil separator (gas-liquid separator) separates the oil from the compressed air (compressed gas), which is discharged from the compressor body, to store the oil. The oil piping system (liquid piping system) supplies the oil, which is stored in the oil separator, to the compressor body.

CITATION LIST

Patent Document

Patent Document 1: JP 2009-85045 A

SUMMARY OF THE INVENTION

Problems to be Solved by the Invention

In the oil supply type air compressor described above, when the oil quantity stored in the oil separator is insufficient, the oil quantity to be supplied to the compressor body is insufficient, so that compression performance or the like deteriorates. For this reason, the oil level height in the oil separator is required to be monitored.

Therefore, if the difference between the pressure of the air and the pressure of the oil in the oil separator is large, a method by which a detector which detects pressure is provided at a predetermined height position in the oil separator can be considered. More specifically, in this method, for example, a threshold value is set in advance between the pressure of the air and the pressure of the oil in the oil separator and it is determined whether or not the pressure detected by the detector exceeds the threshold value, to determine which one of the air and the oil is a fluid existing at the predetermined height position in the oil separator. Accordingly, it is detected whether or not the oil level in the oil separator is lower than the predetermined height position.

Alternatively, if the difference between the temperature of the air and the temperature of the oil in the oil separator is large, a method by which a detector which detects temperature is provided at a predetermined height position in the oil separator can be considered. More specifically, in this method, for example, a threshold value is set in advance between the temperature of the air and the temperature of the oil in the oil separator and it is determined whether or not the temperature detected by the detector exceeds the threshold value, to determine which one of the air and the oil is a fluid existing at the predetermined height position in the oil separator. Accordingly, it is detected whether or not the oil level in the oil separator is lower than the predetermined height position.

However, in reality, there is almost no difference between the pressure of the air and the pressure of the oil in the oil separator in many cases, and there is also almost no difference between the temperature of the air and the temperature of the oil. For this reason, even when the oil level height in the oil separator fluctuates, the detection value of the detector does not fluctuate in the methods, which is a problem.

As another method, it can be also considered that an optical detector which detects the presence and absence of the oil is installed at a predetermined height position in the oil separator. However, the oil separated from the compressed air flows downward in the oil separator. In addition, the oil level in the oil separator may undulate. For this reason, even when the oil level in the oil separator is lower than the predetermined height position, the oil continuously passes by or adheres to the detector, so that the detector erroneously detects the oil level, which is a problem. As a result, this method also has a problem.

The present invention has been made in view of the above situations, and one of tasks is to monitor the liquid level height in a gas-liquid separator.

Solutions to Problems

The configurations described in the claims are applied to solve the above problems. The present invention includes a plurality of means to solve the above problems, and as one example, there is provided a liquid supply type gas compressor including: a compressor body that compresses a gas while injecting a liquid into a compression chamber; a gas-liquid separator that separates the liquid from the compressed gas, which is discharged from the compressor body, to store the liquid; a liquid piping system that supplies the liquid, which is stored in the gas-liquid separator, to the compressor body; an internal pipe that extends in an internal space of the gas-liquid separator, and includes at least two hole portions, of which disposition positions are different from each other in a height direction, on an internal space side to communicate with the liquid piping system; a detector that detects a pressure or a temperature of a fluid flowing through the liquid piping system; a control device that performs at least one of a determination as to whether or not the pressure or the temperature detected by the detector is more than a first set value set in advance and a determination as to whether or not the pressure or the temperature detected by the detector is less than a second set value which is set in advance to be less than the first set value, to determine which one of the gas and the liquid is the fluid flowing through the liquid piping system; and a notification device that notifies a determination result of the control device.

In addition, as another example, there is provided a gas-liquid separator including: an inlet opening into which a gas-liquid mixture of compressed gas containing a gas and a liquid flows; an internal space in which the compressed gas flowing from the inlet opening is separated into the gas and the liquid; an outlet opening through which the liquid separated flows from the internal space to an outside; and an internal pipe that extends from the outlet opening to the internal space, and communicates with the internal space. The internal pipe includes at least two hole portions, of which disposition positions are different from each other in a height direction, on an internal space side.

Effects of the Invention

The present embodiment is based on the finding that when the liquid flows through the liquid piping system, almost no pulsation (in other words, a large change which periodically repeats increasing and decreasing) occurs in pressure or temperature of the fluid, and when the gas flows through the liquid piping system, a pulsation occurs in pressure or temperature of the gas, and it can be determined which one of the gas and the liquid is the fluid flowing through the liquid piping system. Accordingly, the liquid level height in the gas-liquid separator can be monitored.

Incidentally, tasks, configurations, and effects other than those described above will become apparent by the following description.

graphs showing a pattern of the tendency of a detection at each rotation speed according to the first embodiment.

Figure 7:
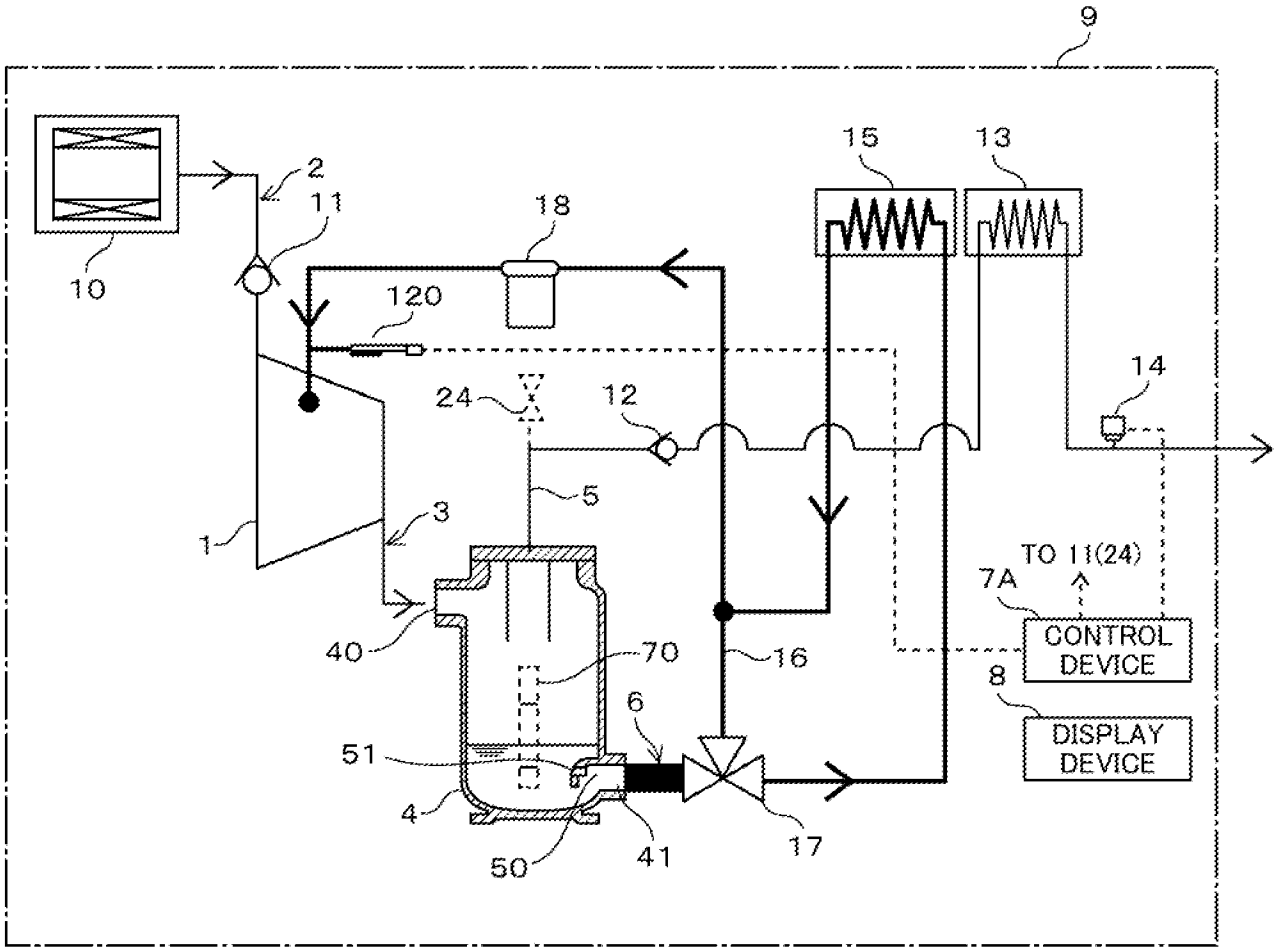

FIG. 7 is a schematic diagram illustrating a configuration of an oil supply type air compressor according to a second embodiment of the present invention.

Figure 8:
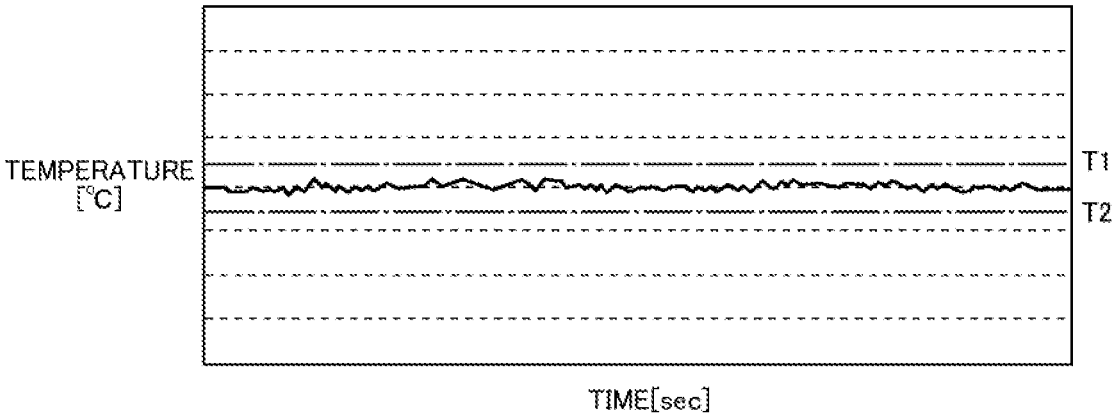

FIG. 8 is a waveform showing a temperature pulsation pattern according to the second embodiment of the present invention.

Figure 9:
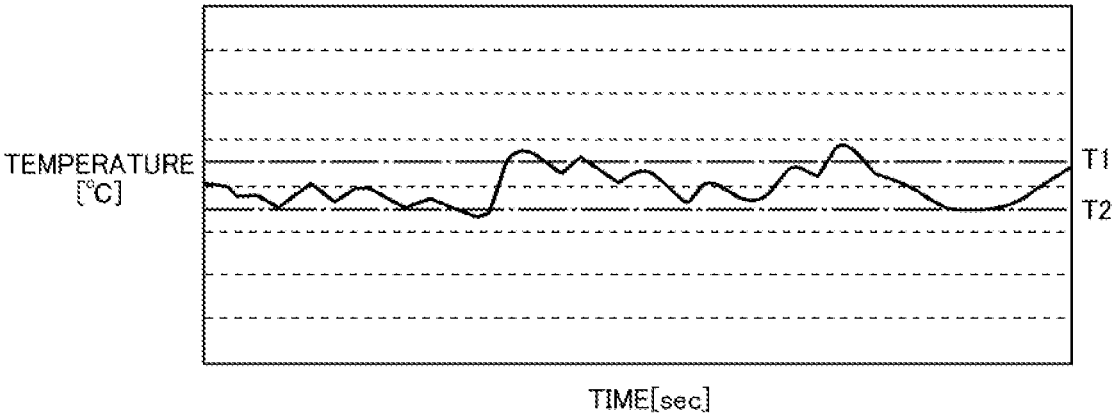

FIG. 9 is a waveform showing a temperature pulsation pattern according to the second embodiment of the present invention.

Figure 10:
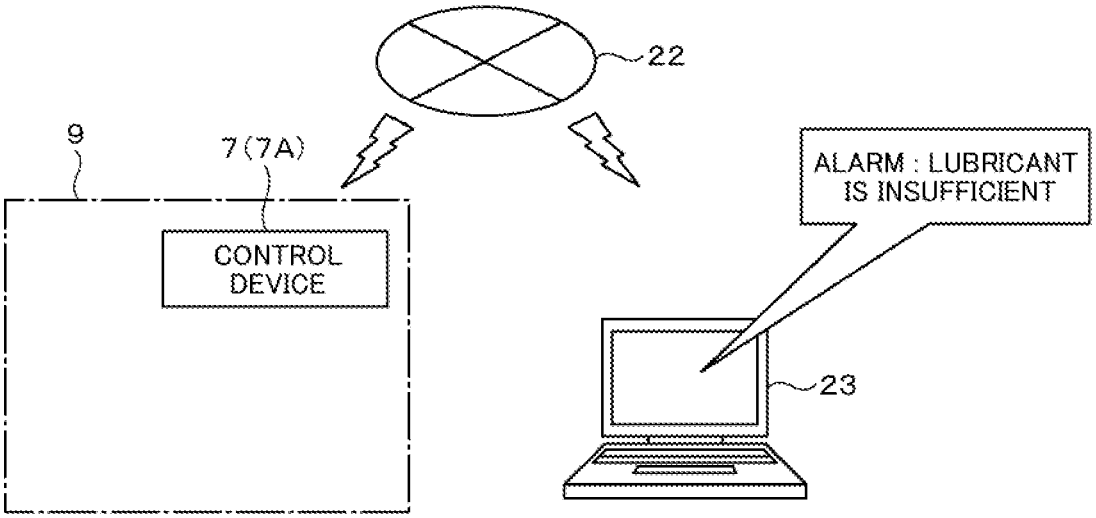

FIG. 10 is a schematic view illustrating a communication terminal in a modification example of the present invention.

MODE FOR CARRYING OUT THE INVENTION

An oil supply type air compressor is taken as an example of a target of application of the present invention, and a first embodiment of the present invention will be described with reference to the drawings.

Figure 1:
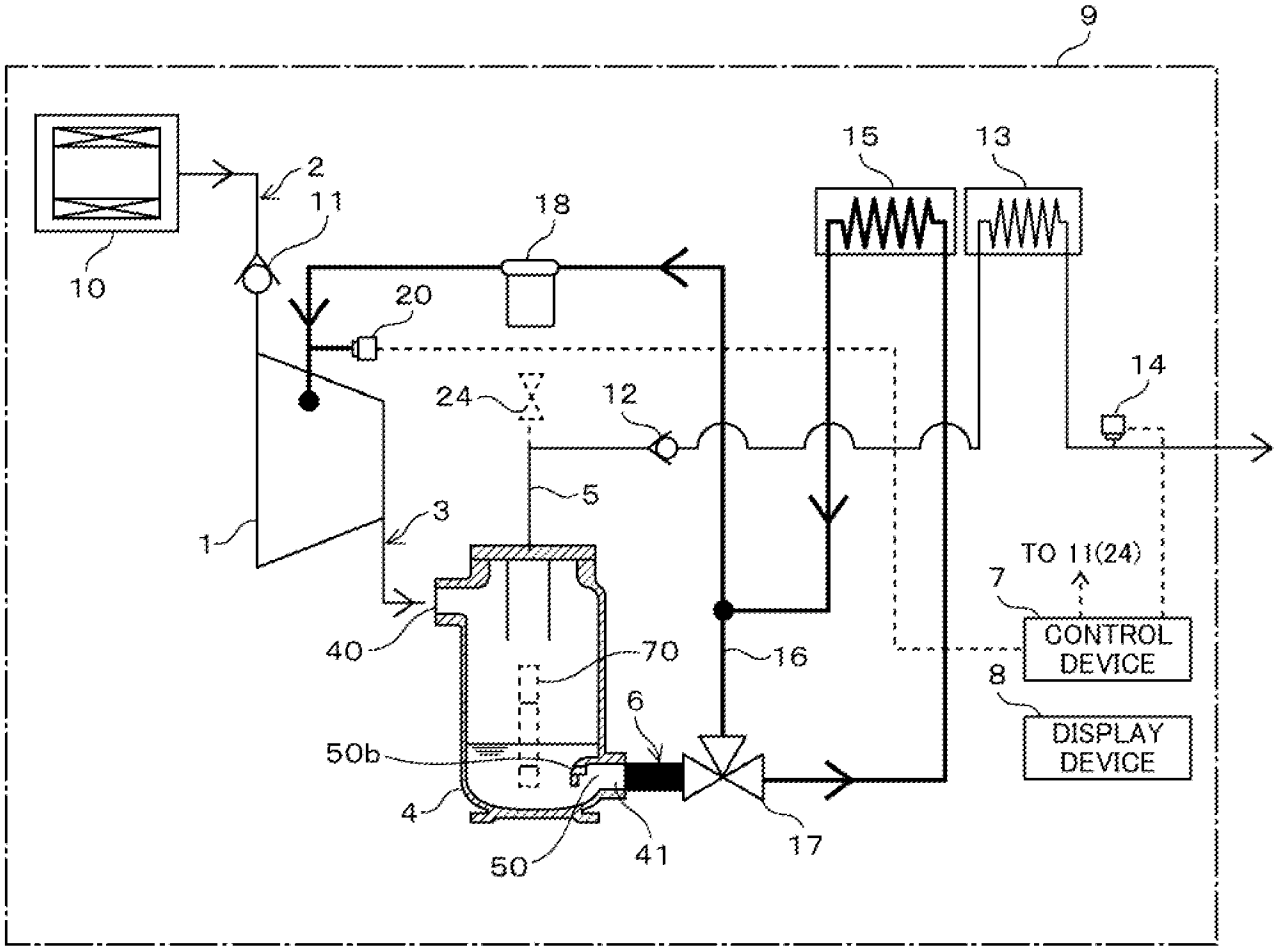
FIG. 1 is a schematic diagram illustrating a configuration of an oil supply type air compressor according to a first embodiment of the present invention.

FIG. 1 is a schematic diagram illustrating a configuration of the oil supply type air compressor of the present embodiment, and illustrates a state where the oil quantity stored in an oil separator is sufficient.

The oil supply type air compressor of the present embodiment includes a compressor body 1, an intake system 2 connected to an intake side of the compressor body 1, an oil separator 4 (gas-liquid separator) connected to a discharge side of the compressor body 1 through a discharge pipe 3, a compressed air piping system 5 connected to an upper portion of the oil separator 4, an oil piping system 6 (liquid piping system) connected between a lower portion of the oil separator 4 and the compressor body 1, a control device 7, and a display device 8. Incidentally, the compressor body 1, the intake system 2, the discharge pipe 3, the oil separator 4, the compressed air piping system 5, the oil piping system 6, the control device 7, and the display device 8 are disposed on the same pedestal (base, pallet, air tank in the case of a tank mount type, or the like) to form a compressor unit 9. Particularly, in the present embodiment, the compressor unit 9 is configured as a housing of which the peripheral surface and the upper surface are surrounded by panel plates. In addition, although not illustrated, an electric motor is applied as a driving source of the compressor body 1.

Although not illustrated in detail, the compressor body 1 includes, for example, a pair of male and female screw rotors that mesh with each other, and a casing that accommodates the screw rotors, and a plurality of compression chambers are formed in tooth grooves of the screw rotors. When the screw rotors rotate, the compression chambers move in an axial direction of the rotors. The compression chamber takes in air (gas) from the intake system 2, compresses the air, and discharges the compressed air (compressed gas) to the discharge pipe 3. The compressor body 1 injects the oil (liquid) into the compression chambers in any stage of a compression process, for example, including immediately after start of compression, for the purpose of cooling compression heat, lubricating the rotors, sealing the compression chambers, and the like.

The intake system 2 includes an intake filter 10 that removes impurities in the air, and an intake throttle valve 11 that is provided downstream of the intake filter 10 to be able to close the intake side of the compressor body 1.

The oil separator 4 utilizes specific gravity separation including swing separation, collision separation, or both to separate the oil from the compressed air, which is discharged from the compressor body 1, to store the separated oil in a lower portion. The compressed air separated in the oil separator 4 is supplied to the destination of use outside the unit through the compressed air piping system 5. The compressed air piping system 5 includes a regulating valve (check valve) 12, an aftercooler (heat exchanger) 13 that is disposed downstream of the regulating valve 12 to cool the compressed air, and a control pressure sensor 14 that is disposed downstream of the regulating valve 12 to detect the pressure of the compressed air (namely, pressure fluctuating according to the quantity of use of the compressed air). The control pressure sensor 14 outputs the detected pressure to the control device 7. Details will be described later.

The oil stored in the oil separator 4 is supplied to the compression chambers through the oil piping system 6 due to a pressure difference between the oil separator 4 and the compression chambers of the compressor body 1. Namely, the oil piping system 6 is a flow path system in which the oil returns from the oil separator 4 to the compressor body 1. In the present embodiment, the oil piping system 6 includes an oil cooler (heat exchanger) 15 that cools the oil, a bypass pipe 16 that bypasses the oil cooler 15, a temperature regulating valve (three-way valve) 17 that is provided at an inlet (branch point) of the bypass pipe 16, and an oil filter 18 that is disposed downstream of an outlet (merge point) of the bypass pipe 16 to remove impurities in the oil. Incidentally, in the present embodiment, the configuration in which the oil is supplied to the compression chambers through the oil piping system 6 due to the pressure difference between the oil separator 4 and the compression chambers of the compressor body 1 is provided as an example; however, a pressure feed device such as an oil pump may be disposed in the oil piping system 6 to supply the oil to the compression chambers. In addition, in the present embodiment, an oil level gauge 70 through which the oil level is visible due to a height difference is provided on an outer periphery of the gas-liquid separator.

The temperature regulating valve 17 detects the temperature of the oil, and regulates the ratio between the flow rate of an oil cooler 15 side and the flow rate of a bypass pipe 16 side according to the temperature of the oil. Accordingly, the temperature of the oil supplied to the compressor body 1 is regulated.

A pressure sensor 20 is disposed at any position in the oil piping system 6 (including the bypass pipe 16). It is preferable that the disposition position of the pressure sensor 20 is an intermediate position between the gas-liquid separator 4 and the temperature regulating valve 17 or the pressure sensor 20 is disposed downstream of a merge point between the bypass pipe 16 and an outlet side of the oil cooler 15; however, the present invention is not limited thereto, and the pressure sensor 20 may be disposed upstream of the oil cooler 15 (between an inlet of the oil cooler 15 and the gas-liquid separator 4). The pressure sensor 20 detects a change in pressure inside the oil piping system 6 to communicate the detected value to the control device 7.

The control device 7 includes an arithmetic control unit (for example, a CPU) that executes arithmetic processing or control processing in cooperation with a program, and storage units (for example, a ROM and a RAM) that stores the program and the result of the arithmetic processing. As an operation control function, the control device 7 controls the open and closed state of the intake throttle valve 11 according to the pressure detected by the control pressure sensor 14 to switch the operation state of the compressor body 1 according to the controlled state. Incidentally, the entirety or a part of the control device 7 can be also configured as an analog circuit.

More specifically, during load operation of the compressor body 1 (in other words, when the intake throttle valve 11 is in an open state), the control device 7 determines whether or not the pressure detected by the control pressure sensor 14 has risen to an unload start pressure Pu set in advance. Then, when the pressure detected by the control pressure sensor 14 reaches the unload start pressure Pu, the intake throttle valve 11 is controlled to be in a closed state, so that the compressor body 1 is switched to a no-load operation.

In addition, during no-load operation of the compressor body 1 (in other words, when the intake throttle valve 11 is in a closed state), the control device 7 determines whether or not the pressure detected by the control pressure sensor 14 has decreased to a load return pressure Pd (here, Pd<Pu) set in advance. Then, when the pressure detected by the control pressure sensor 14 reaches the load return pressure Pd, the intake throttle valve 11 is controlled to be in an open state, so that the compressor body 1 is switched to a load operation. When the quantity of use of the compressed air has decreased, power consumption can be reduced by the above-described operation switching.

The oil separator 4 has a body shape having a substantially tubular internal space. The oil separator 4 includes an inlet opening 40, into which a gas-liquid mixture of the compressed air discharged from the compressor body 1 flows, on an upper side of the oil separator 4. The oil separator 4 includes an air pipeline, which has a tubular shape and extends downward from a vertical direction, in the internal space, and the separated air flows from the air pipeline to the air piping system. In addition, the separated oil is stored in a bottom portion of the internal space. An outlet opening 41 through which the stored oil flows to the oil piping system 6 is provided on a lower side of a body side surface of the oil separator 4. Then, the oil separator 4 includes an oil outlet pipeline 50 extending from the outlet opening 41 toward the internal space.

Figure 2A:
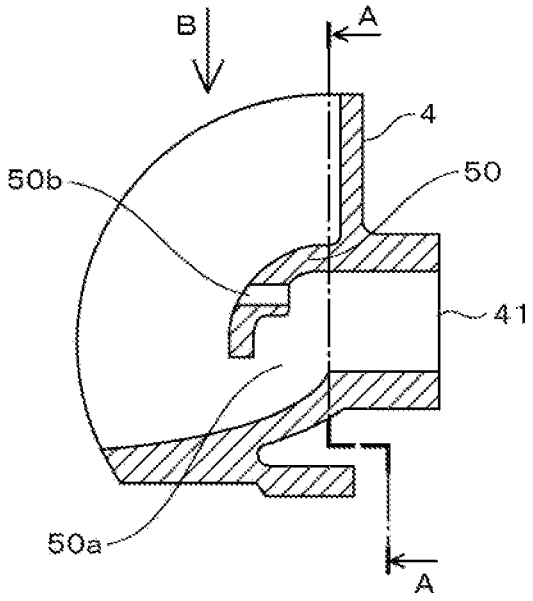
FIGS. 2A-2C are partially enlarged views illustrating a configuration of an oil separator according to the first embodiment.
Figure 2B:
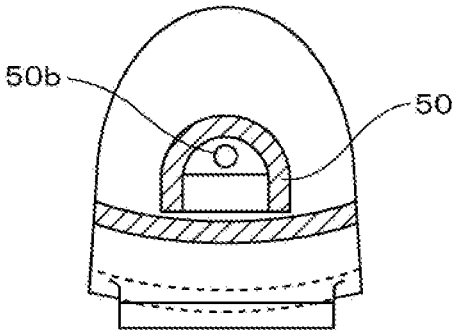
Figure 2C:
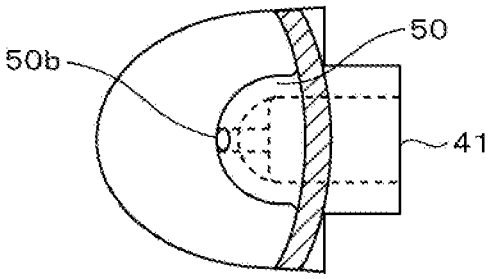

The configuration of the vicinity of the outlet of the oil separator 4 will be described in detail with reference to FIG. 2. FIG. 2(*a*) illustrates a partially enlarged cross-sectional side view (enlarged view observed in the direction of FIG. 1) of the vicinity of the outlet opening 41. FIG. 2(*b*) illustrates a cross-sectional view taken along line A-A in FIG. 2(*b*). FIG. 2(*c*) illustrates a view seen from arrow B in FIG. 2(*a*).

In FIG. 2(*a*), the oil outlet pipeline 50 is an internal flow path extending from the outlet opening 41 toward the internal space of the oil separator 4. The oil outlet pipeline 50 has a substantially R shape in which a hole portion 50*a* into which the oil flows is open toward a bottom portion side of the gas-liquid separator 4. The stored oil flows mainly from the hole portion 50*a* to the outside of the gas-liquid separator 4 through the outlet opening 41. Incidentally, the oil outlet pipeline 50 is not necessarily limited to an R shape. In addition, it is preferable that an opening direction of the hole portion 50*a* is a vertical direction; however, the present invention is not limited thereto, and the hole portion 50*a* may be configured to be open in any direction between the vertical direction and a horizontal direction.

In addition, as illustrated in FIG. 2(*b*) or FIG. 2(*c*), the oil outlet pipeline 50 includes a hole portion 50*b*, which is a detection flow path for detecting an oil quantity, in the middle of a pipeline above the hole portion 50*a*. Namely, one of the features is that the hole portions 50*a* and 50*b* have different heights. It is preferable that the hole portion 50*b* is open in the horizontal direction toward the internal flow path of the oil outlet pipeline 50, but may be open to a vertical direction side with respect to the horizontal direction. The oil outlet pipeline 50 allows the internal space of the gas-liquid separator 4 and the oil piping system 6 to communicate with each other also through the hole portion 50*b*. In addition, as illustrated in FIG. 2, the diameter (opening area) of the hole portion 50*b* is smaller than the diameter (opening area) of the hole portion 50*a* of the internal flow path.

Incidentally, in the present embodiment, a case where one hole portion 50*a* and one hole portion 50*b* are provided is described; however, a plurality of the hole portions 50*a* and/or the hole portions 50*b* are provided. In this case, it can be said that the total diameter area of the hole portion 50*b* is preferably smaller than the total diameter area of the hole portion 50*a*. Namely, when the oil in the gas-liquid separator 4 is sufficient (when the oil level position is higher than the position of the oil outlet pipeline 50), the oil flows out also from the hole portion 50*b*, and eventually, when the oil starts to become insufficient (when the oil level starts to decrease), the air gradually flows from the hole portion 50*b* to the internal flow path, and when the oil is further insufficient, the air flows from both the hole portions 50*a* and 50*b* to the oil piping system 6. The reason is that since a liquid is generally more viscous than a gas, when the opening areas of the hole portions 50*a* and 50*b* are equal or the opening area of the hole portion 50*b* is larger, during the transition period of reduction in oil quantity, the air is dominant in the ratio of the fluid flowing through the oil outlet pipeline 50, so that the oil storage performance of the oil separator 4 may decrease. Incidentally, the present invention is not limited thereto.

Figure 3A:
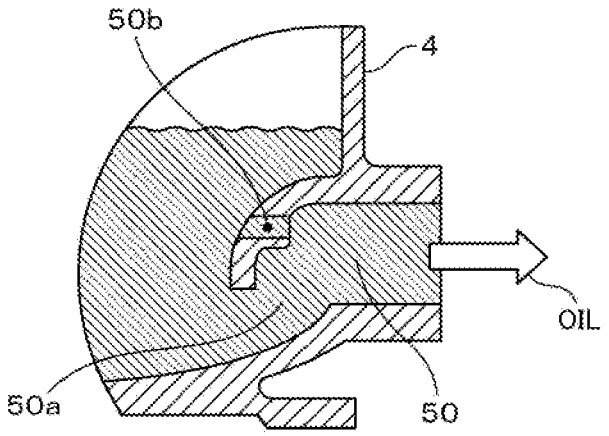
FIGS. 3A-3C provide state transition views illustrating a pattern in which an oil and air flow according to the first embodiment.
Figure 3B:
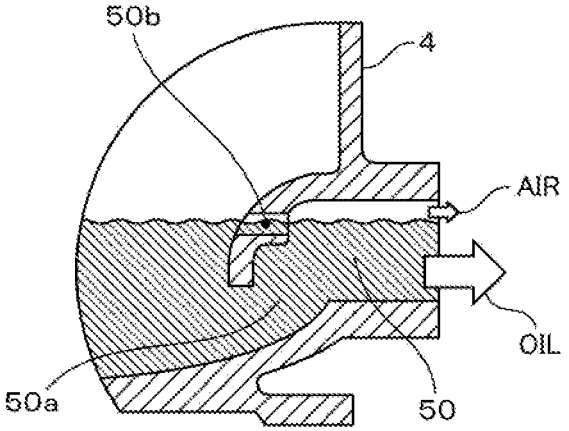
Figure 3C:
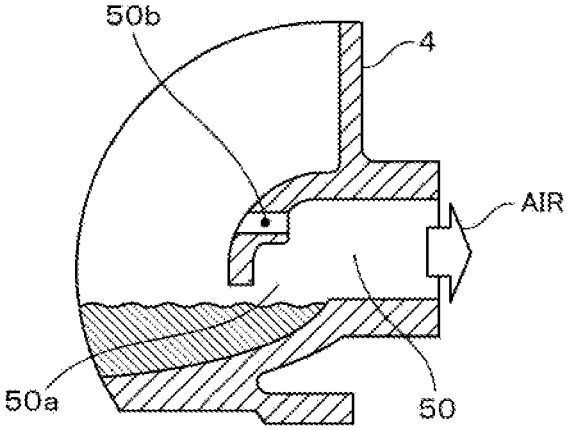

FIG. 3 schematically illustrates a transition in oil and air quantities flowing through the internal pipe. FIG. 3(*a*) illustrates a state where the oil quantity is a proper quantity or more. In this case, since the oil level position is above the hole portion 50*b*, only the oil flows through the oil piping system 6. FIG. 3(*b*) illustrates a state where the oil quantity starts to be reduced. Since the oil level position is equal to or lower than the hole portion 50*b* and is higher than the hole portion 50*a*, the air starts to flow from the hole portion 50*b*, and the air starts to be mixed with the oil in the oil outlet pipeline 50. Eventually, as the reduction in oil quantity makes progress, the air quantity also increases. FIG. 3(*c*) illustrates a state where the oil quantity is insufficient. The oil level position is lower than the hole portion 50*a*, and the air is dominant in the internal flow path.

As described above, the ratio between the oil and the air flowing through the oil piping system 6 can be transiently changed by the hole portion 50*b*. Since the ratio between the oil and the air is changed, a pressure fluctuation occurs in the oil piping system 6. In the present embodiment, one of the features is that the pressure sensor 20 described above detects the pressure fluctuation, so that the control device 7 can monitor an increase and decrease in oil quantity. Hereinafter, an oil quantity (oil level height) detection function of the control device 7 will be described.

For example, during no-load operation of the compressor body 1 (in other words, when the oil level in the oil separator 4 is lower than that during no-load operation of the compressor body 1), the control device 7 performs a determination as to whether or not the pressure detected by the pressure sensor 20 is out of a set range set in advance (in other words, a determination as to whether or not the pressure is more than a set value P1 set in advance and a determination as to whether or not the pressure is less than a set value P2 set in advance (here, P2<P1)), to determine which one of the air and the oil is the fluid flowing through the oil piping system 6 (alternatively, which one mainly flows or how large the ratio between the air and the oil is), and outputs a determination result to the display device 8. The display device 8 notifies the determination result of the control device 7.

Figure 4:
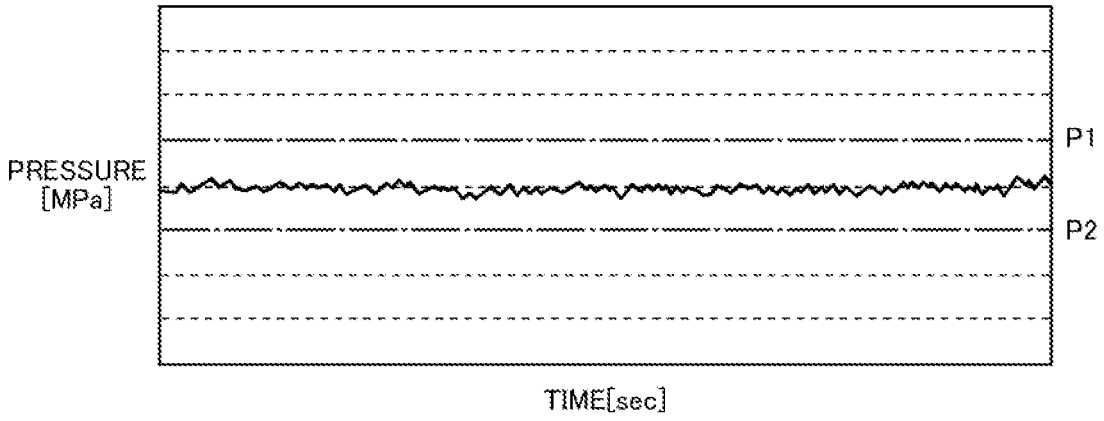
FIG. 4 is a waveform showing a pressure pulsation pattern according to the first embodiment.

More specifically, as illustrated in FIG. 3(*a*), when the oil level in the oil separator 4 is higher than the hole portion 50*b*, the oil flows through the oil piping system 6. In this case, as shown in FIG. 4, the pressure of the oil detected by the pressure sensor 20 is not subjected to a pulsation, and is in the set range (in other words, from the set value P2 to the set value P1). For this reason, the control device 7 determines that the fluid flowing through the oil piping system 6 is the oil. Accordingly, it can be detected that the oil level in the oil separator 4 is higher than the hole portion 50*b*.

Figure 5:
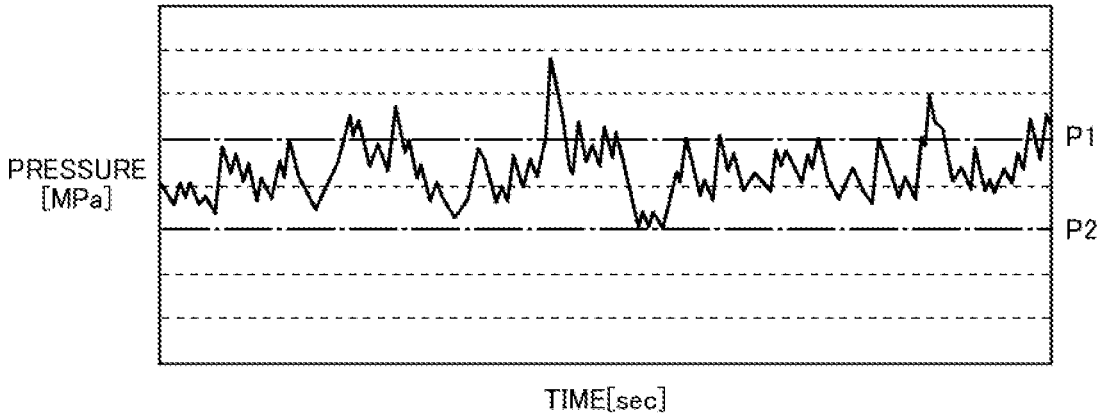
FIG. 5 is a waveform showing a pressure pulsation pattern according to the first embodiment.
Figure 6A:
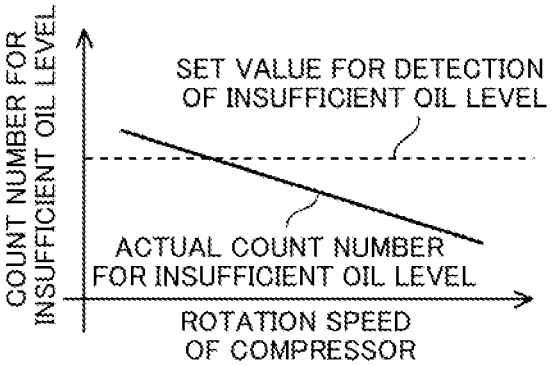
FIGS. 6A-6D provide graphs showing a pattern of the tendency of a detection at each rotation speed according to the first embodiment.
Figure 6B:
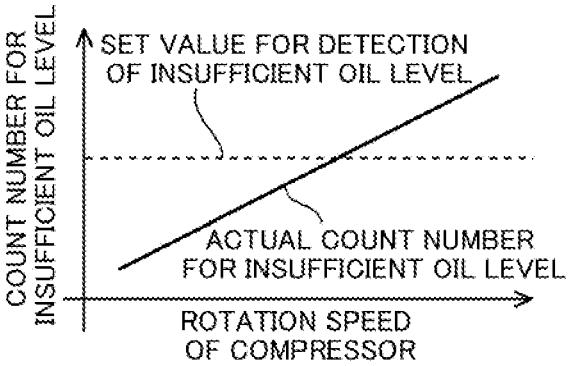
Figure 6C:
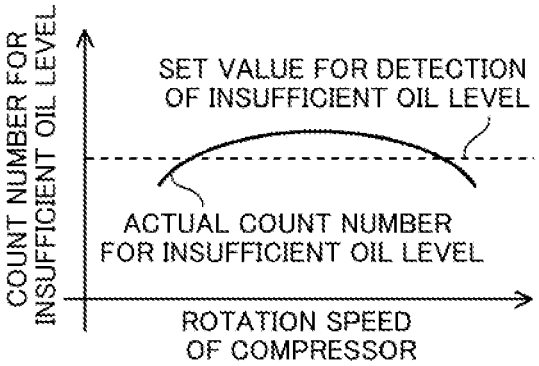
Figure 6D:
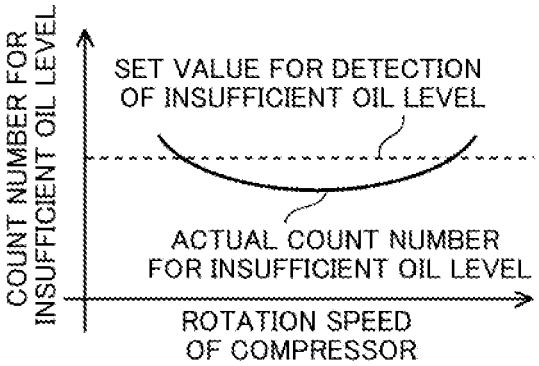

On the other hand, as illustrated in FIGS. 3(*b*) and 3(*c*), when the oil level in the oil separator 4 is lower than the hole portion 50*b*, the air and the oil or the air flows through the oil piping system 6. In this case, as s in FIG. 5, the pressure of the air detected by the pressure sensor 20 is subjected to a pulsation, and is out of the set range (in other words, more than the set value P1 or less than the set value P2). For this reason, the control device 7 determines that the fluid flowing through the oil piping system 6 is the air (alternatively, the air mainly flows or the ratio of the air is a predetermined ratio or more). Accordingly, it can be detected that the oil level in the oil separator 4 is lower than the hole portion 50*b* or the hole portion 50*a*.

When the control device 7 inputs a determination result that the fluid flowing through the hole portion 50*b* is the air, the display device 8 displays, for example, a message such as "alarm: lubricant is insufficient" or "alarm: please replenish lubricant" or the like as notification information based on the determination result. In addition, a determination result that the fluid flowing through the oil piping system 6 is the oil may be input, and the display device 8 may display a message such as "lubricant is sufficient" or the like as information based on the determination result. Incidentally, a notification method may be carried out in various modes such as sound, vibration, and a combination thereof.

Next, as one of the features of the present embodiment, a function of accurately detecting an oil level position (increase and decrease in oil quantity) even when the tendency of an oil level condition differs during operation will be described. For example, the oil level position may be depend on the structure of the gas-liquid separator 4, and the state of the oil level occurring during operation may not be uniform. When a threshold pressure to be counted at this time is constant, the accuracy of detecting an increase and decrease in oil quantity may change depending on operating conditions.

Therefore, there is provided a technique in which a threshold value for an increase and decrease in oil quantity which is determined by the control device 7 is corrected for a pulsation pattern which changes according to the structure of the gas-liquid separator 4, to accurately execute a general-purpose determination.

FIGS. 6(*a*) to 6(*d*) show a relationship between the rotation speed of the compressor body 1 and a tendency, which changes depending on the internal structure of the gas-liquid separator 4.

FIG. 6(*a*) shows a pattern in which the count number for a determination on an increase and decrease in oil quantity, which is performed using the pressure sensor 20, decreases as the rotation speed of the compressor body 1 increases. When the rotation speed is low, the count number for the determination is large, and when the rotation speed increases, the count number tends to decrease. In this case, an actual count number is multiplied by a rotation speed ratio to perform a correction to flatten the pressure value to be counted to determine that the oil quantity is insufficient. Alternatively, the set value for detection may be inclined according to the rotation speed.

FIG. 6(*b*) shows a pattern in which the count number for a determination on an increase and decrease in oil quantity, which is performed using the pressure sensor 20, increases as the rotation speed of the compressor body 1 increases. When the rotation speed is low, the count number for the determination is small, and when the rotation speed increases, the count number tends to increase. In this case, an actual count number is multiplied by a rotation speed ratio to perform a correction to flatten the pressure value to be counted to determine that the oil quantity is insufficient. Alternatively, the set value for detection may be inclined according to the rotation speed.

FIG. 6(*c*) shows a pattern in which when the compressor body 1 rotates at an intermediate rotation speed, the count number for a determination on an increase and decrease in oil quantity, which is performed using the pressure sensor 20, increases. The pattern has a convex tendency in which the count number decreases at upper and lower limit rotation speeds, and the count number increases at the intermediate rotation speed. At this time, the set value for detection is convexly inclined according to the rotation speed.

FIG. 6(*d*) shows a pattern in which when the compressor body 1 rotates at upper and lower limit rotation speeds, the count number for a determination on an increase and decrease in oil quantity, which is performed using the pressure sensor 20, increases. The pattern has a concave tendency in which the count number increases at the upper and lower limit rotation speeds, and the count number decreases at an intermediate rotation speed. At this time, the set value for detection is concavely inclined.

As described above, even when the tendency of pulsation of the oil and the air flowing through the oil piping system 6 differs depending on operating conditions, an increase and decrease in oil quantity can be accurately detected by performing a correction according to each of the tendencies. Such a correction value may be stored in the control device 7 in advance, or may be calculated with a predetermined coefficient according to the rotation speed by the control device 7.

As described above, the present embodiment is based on the finding that when oil (liquid) flows through the oil piping system 6, almost no pulsation occurs in pressure of the oil, and when air (gas) flows through the oil piping system 6, a pulsation occurs in pressure of the air, and it can be determined which one of the oil and the air is the fluid flowing through the oil piping system 6 (alternatively, which one mainly flows). Accordingly, the oil level height in the oil separator 4 can be accurately monitored.

In addition, in the present embodiment, the oil level gauge 70 is also provided in addition to the above-described monitoring of the oil level, so that the oil quantity can be more reliably managed.

Incidentally, in the first embodiment, the case where the control device 7 performs a determination as to whether or not the pressure detected by the pressure sensor 20 is out of the set range (in other words, both a determination as to whether or not the pressure detected by the pressure sensor 20 is more than the set value P1 and a determination as to whether or not the pressure is less than the set value P2), to determine which one of the air and the oil is the fluid flowing through the oil piping system 6 (alternatively, which one mainly flows) has been described as an example; however, the present invention is not limited to the case, and a modification can be made without departing from the intent and the technical concept of the present invention.

As a first modification example, the control device 7 may perform one of a determination as to whether or not the pressure detected by the pressure sensor 20 is more than the set value P1 and a determination as to whether or not the pressure is less than the set value P2, to determine which one of the air and the oil is the fluid flowing through the oil piping system 6 (alternatively, which one mainly flows). Even in such a modification example, the same effect as described above can be obtained.

As a second modification example, the control device 7 may perform one or both of a determination as to whether or not the frequency of occurrences of an event in which the pressure detected by the pressure sensor 20 is more than the set value P1 is more than a predetermined value and a determination as to whether or not the frequency of occurrences of an event in which the pressure detected by the pressure sensor 20 is more than the set value P2 is less than a predetermined value, to determine which one of the air and the oil is the fluid flowing through the oil piping system 6 (alternatively, which one mainly flows). Even in such a modification example, the same effect as described above can be obtained.

As a third modification example, the control device 7 may calculate a change rate of the pressure detected by the pressure sensor 20 (specifically, for example, a change rate of the pressure obtained at detection time intervals of the pressure sensor 20), and perform one or both of a determination as to whether or not the change rate is more than a positive set value set in advance and a determination as to whether or not the change rate is less than a negative set value set in advance, to determine which one of the air and the oil is the fluid flowing through the oil piping system 6 (alternatively, which one mainly flows). Even in such a modification example, the same effect as described above can be obtained.

A second embodiment of the present invention will be described with reference to the drawings. Incidentally, in the present embodiment, the same parts as those in the first embodiment are denoted by the same reference signs, and the description thereof will be appropriately omitted.

FIG. 7 is a schematic diagram illustrating a configuration of an oil supply type air compressor in the present embodiment, and illustrates a state where the oil quantity stored in the oil separator 4 is sufficient.

The oil supply type air compressor of the present embodiment mainly differs from the first embodiment in that the oil supply type air compression includes a temperature sensor 120 (detector) which detects the temperature of a fluid flowing through the oil piping system 6, instead of the pressure sensor 20. The temperature sensor 120 outputs a detected temperature to a control device 7A.

As an oil level height detection function, the control device 7A performs a determination as to whether or not the temperature detected by the temperature sensor 120 during load operation of the compressor body 1 is out of a set range set in advance (in other words, both a determination as to whether or not the temperature is more than a set value T1 set in advance and a determination as to whether or not the temperature is less than a set value T2 set in advance (here, T2<T1)), to determine which one air and an oil is the fluid flowing through the oil piping system 6, and outputs a determination result to the display device 8.

When the oil level in the oil separator 4 is higher than the hole portion 50*b*, the oil flows through the oil piping system 6. In this case, as shown in FIG. 8, the temperature of the oil detected by the temperature sensor 120 is not subjected to a pulsation, and is in the set range (in other words, from the set value T2 to the set value T1). For this reason, the control device 7A determines that the fluid flowing through the oil piping system 6 is the oil. Accordingly, it can be detected that the oil level in the oil separator 4 is higher than the predetermined hole portion 50*b*.

On the other hand, when the oil level in the oil separator 4 is lower than the hole portion 50*b*, the air flows through the oil piping system 6. In this case, as shown in FIG. 9, the temperature of the air detected by the temperature sensor 120 is subjected to a pulsation, and is out of the set range (in other words, more than the set value T1 or less than the set value T2). For this reason, the control device 7A determines that the fluid flowing through the oil piping system 6 is the air. Accordingly, it can be detected that the oil level in the oil separator 4 is lower than the hole portion 50*b*.

When a determination result that the fluid flowing through the oil piping system 6 is the air is input, the display device 8 displays, for example, a message such as "alarm: lubricant is insufficient" or "alarm: please replenish lubricant" or the like as information based on the determination result. In addition, a determination result that the fluid flowing through the oil piping system 6 is the oil may be input, and the display device 8 may display a message such as "lubricant is sufficient" or the like as information based on the determination result.

As described above, the present embodiment is based on the finding that when oil (liquid) flows through the oil piping system 6, almost no pulsation occurs in temperature of the oil, and when air (gas) flows through the oil piping system 6, a pulsation occurs in temperature of the air, and it can be determined which one of the oil and the air is the fluid flowing through the oil piping system 6 (alternatively, which one mainly flows or how large the ratio of the air or oil is). Accordingly, the oil level height in the oil separator 4 can be accurately monitored.

Incidentally, in the second embodiment, the case where the control device 7A performs a determination as to whether or not the temperature detected by the temperature sensor 120 is out of the set range (in other words, both a determination as to whether or not the temperature detected by the temperature sensor 120 is more than the set value T1 and a determination as to whether or not the temperature is less than the set value T2), to determine which one of the air and the oil is the fluid flowing through the oil piping system 6 (alternatively, which one mainly flows) has been described as an example; however, the present invention is not limited to the case, and a modification can be made without departing from the intent and the technical concept of the present invention.

As a fourth modification example, the control device 7A may perform one of a determination as to whether or not the temperature detected by the temperature sensor 120 is more than the set value T1 and a determination as to whether or not the temperature is less than the set value T2, to determine which one of the air and the oil is the fluid flowing through the oil piping system 6 (alternatively, which one mainly flows). Even in such a modification example, the same effect as described above can be obtained.

As a fifth modification example, the control device 7A may perform one or both of a determination as to whether or not the frequency of occurrences of an event in which the temperature detected by the temperature sensor 120 is more than the set value T1 is more than a predetermined value and a determination as to whether or not the frequency of occurrences of an event in which the temperature detected by the temperature sensor 120 is less than the set value T2 is more than a predetermined value, to determine which one of the air and the oil is the fluid flowing through the oil piping system 6 (alternatively, which one mainly flows). Even in such a modification example, the same effect as described above can be obtained.

As a sixth modification example, the control device 7A may calculate a change rate of the temperature detected by the temperature sensor 120 (specifically, for example, a change rate of the temperatures obtained at detection time intervals of the temperature sensor 120), and perform one or both of a determination as to whether or not the change rate is more than a positive set value set in advance and a determination as to whether or not the change rate is less than a negative set value set in advance, to determine which one of the air and the oil is the fluid flowing through the oil piping system 6 (alternatively, which one mainly flows). Even in such a modification example, the same effect as described above can be obtained.

In addition, in the first and second embodiments and the above modification examples, the case where a notification device which notifies a determination result of the control device 7 or 7A is the display device 8 that is mounted in the compressor unit 9 to display information based on the determination result of the control device 7 or 7A has been described as an example; however, the present invention is not limited to the case, and a modification can be made without departing from the intent and the technical concept of the present invention. As in a seventh modification example illustrated in FIG. 10, the notification device may be a communication terminal 23 that is separated from the compressor unit 9 to display information (specifically, for example, a message such as "alarm: lubricant is insufficient" or "alarm: please replenish lubricant" or the like) based on a determination result of the control device 7 or 7A, the determination result being received via a communication line 22. Incidentally, as long as the communication terminal 23 is configured to be separated as a communication connection configuration, the communication terminal 23 may be configured to be physically in contact with the compressor unit 9. For example, the communication terminal 23 may be configured to be placed or suspended in any place in the compressor unit 9 and to be temporarily fixed so as to be separable.

In addition, as another configuration of utilizing the communication line illustrated in FIG. 10, a configuration in which an external arithmetic device (server or the like) connected via the communication line 22 has the determination function of the control device 7 or 7A, and the external arithmetic device notifies the communication terminal 23 of a determination result via the communication line 22 may be employed. Further, a configuration in which the communication terminal 23 has the determination function of the control device 7 or 7A may be employed.

Incidentally, although not illustrated, the notification device may be, for example, an alarm lamp or an alarm buzzer mounted in the compressor unit 9. Then, when the control device 7 or 7A determines that the fluid flowing through the oil piping system 6 is the air, the control device 7 or 7A may drive the alarm lamp, the alarm buzzer, or an alarm vibration. Even in the modification example, the same effect as described above can be obtained.

In addition, in the first and second embodiments, the case where, in order to switch the compressor body 1 from a load operation to a no-load operation, the oil supply type air compressor is provided with the intake throttle valve 11 that closes the intake side of the compressor body 1 has been described as an example; however, the present invention is not limited to the case, and a modification can be made without departing the intent and the technical concept of the present invention.

In order to switch the compressor body 1 from a load operation to a no-load operation, the oil supply type air compressor may include a gas release valve 24 that releases air from the discharge side of the compressor body 1 (specifically, an upstream side of the regulating valve 12 of the compressed air piping system 5), instead of the intake throttle valve 11. Then, when the pressure detected by the control pressure sensor 14 reaches the unload start pressure Pu, the control device 7 or 7A controls the gas release valve 24 to be in an open state to thus switch the compressor body 1 from a load operation to a no-load operation. In addition, when the pressure detected by the control pressure sensor 14 reaches the load return pressure Pd, the gas release valve 24 is controlled to be in a closed state, so that the compressor body 1 is switched from a no-load operation to a load operation.

Alternatively, the oil supply type air compressor may include both the intake throttle valve 11 and the gas release valve 24. In addition, the oil supply type air compressor may be configured to not switch the compressor body 1 from a load operation to a no-load operation. Namely, the intake throttle valve 11 or the gas release valve 24 may not be provided, and the control device 7 or 7A may not have the above-described operation control function. Even in the modification example, the same effect as described above can be obtained.

In addition, the oil supply type air compressor may have variable speed control. Namely, the rotation speed of the rotors may be changed by a change in frequency made by an inverter or a change in rotation ratio made by gear switching. There is a method by which in a no-load operation of variable speed control, when the pressure detected by the control pressure sensor 14 reaches the unload start pressure Pu, the intake throttle valve 11 is brought into a closed state, or the inverter frequency is lowered (for example, in a range where the performance of the oil supply type air compressor is maintained) to rotate a motor at the minimum speed, and when the detected pressure rises to a gas release pressure Pp which is a higher pressure than the unload start pressure Pu, the gas release valve 24 is brought into an open state to save energy. In addition, after the gas release valve 24 is opened, when the pressure detected by the control pressure sensor 14 is equal to the unload start pressure Pu or is less than or equal to a predetermined pressure higher than the unload start pressure Pu and lower than a gas release pressure Pp, control may be performed to close the gas release valve 24 to bring the oil supply type air compressor into a load state in an unload operation. Thereafter, when the pressure detected by the control pressure sensor 14 further decreases and reaches the load return pressure Pd, control may be performed to drive the oil supply type air compressor in a full load operation in which the intake throttle valve 11 is in an open state and the rotation speed of the motor is controlled by the inverter to increase the rotation speed.

Incidentally, the case where the present invention is applied to the oil supply type air compressor has been described above as an example; however, the present invention is not limited to the case, and may be applied to a liquid supply type gas compressor using another liquid instead of oil. For example, the present invention may be applied to a water supply type air compressor including a compressor body that compresses air (gas) while injecting water (liquid) into a compression chamber, a water separator (gas-liquid separator) that separates the water from the compressed air (compressed gas), which is discharged from the compressor body, to store the water, and a water piping system (liquid supply system) that supplies the water, which is stored in the water separator, to the compressor body. When the present invention is applied to the water supply type air compressor, the water level height in the water separator can be monitored. In addition, the present invention may be applied to a compressor that compresses a gas other than air.

In addition, a compression mechanism of a so-called twin screw rotor including male and female screw rotors has been described above as an example; however, the present invention is not limited thereto. For example, various compression mechanisms such as a positive displacement type and a turbo type can be also applied. The positive displacement type is a rotary type, a reciprocating type, or the like, and the rotary type includes a single, twin or multi screw rotor type, a single or multi scroll wrap type, a vane type, a claw type, and the like. The reciprocating type includes a single or multi reciprocating type, and the like. Further, the present invention is not limited to a configuration in which one compressor body is provided, and can be applied to a multi-stage configuration in which the same type or different types are combined.

In addition, the electric motor is an example of a driving source; however, the present invention is not limited thereto. An internal combustion engine, a steam engine, a driving source that utilizes energy such as wind power or hydraulic power, and the like can be also applied.

REFERENCE SIGNS LIST

1 Compressor body
4 Oil separator (gas-liquid separator)
5 Compressed air piping system
6 Oil piping system (liquid supply system)
7, 7A Control device
8 Display device (notification device)
9 Compressor unit
11 Intake throttle valve
20 Pressure sensor (detector)
22 Communication line
23 Communication terminal (notification device)
24 Gas release valve
40 Inlet opening
41 Outlet opening
50 Oil outlet pipeline
50*a*, 50*b* Hole portion
70 Oil level gauge
120 Temperature sensor (detector)

The invention claimed is:

1. A liquid supply gas compressor comprising:

a compressor body that compresses a gas while injecting a liquid into a compression chamber;

a gas-liquid separator that separates the liquid from the compressed gas, which is discharged from the compressor body, to store the liquid;

a liquid piping system that supplies the liquid, which is stored in the gas-liquid separator, to the compressor body;

an internal pipe that extends in an internal space of the gas-liquid separator, and includes at least two hole portions, of which disposition positions are different from each other in a height direction, on an internal space side to communicate with the liquid piping system;

a sensor that detects a pressure or a temperature of a fluid flowing through the liquid piping system;

a controller that generates a determination result by performing at least one of a determination as to whether or not the pressure or the temperature detected by the sensor is more than a first set value set in advance and a determination as to whether or not the pressure or the temperature detected by the sensor is less than a second set value which is set in advance to be less than the first set value, to determine which one of the gas and the liquid is the fluid flowing through the liquid piping system; and a displayer that notifies a determination result of the controller.

2. The liquid supply gas compressor according to claim 1, wherein in the hole portions, a diameter area of one hole portion located at a high position is less than or equal to a diameter area of the other hole portion located at a low position.

3. The liquid supply gas compressor according to claim 1, wherein the one hole portion located at the high position is open in a horizontal direction of the gas-liquid separator, and the other hole portion located at the low position is open to a vertical direction side with respect to an opening direction of the one hole portion.

4. The liquid supply gas compressor according to claim 1, wherein the controller performs both the determination as to whether or not the pressure or the temperature detected by the sensor is more than the first set value set in advance and the determination as to whether or not the pressure or the temperature detected by the sensor is less than the second set value which is set in advance to be less than the first set value, to determine which one of the gas and the liquid is the fluid flowing through the liquid piping system.

5. The liquid supply gas compressor according to claim 1, further comprising:

at least one of an intake throttle valve which closes an intake side of the compressor body and a gas release valve which releases the gas from a discharge side of the compressor body, in order to switch the compressor body from a load operation to a no-load operation.

6. The liquid supply gas compressor according to claim 1, wherein the compressor body, the gas-liquid separator, and the liquid piping system form a compressor unit that is disposed on the same base, and the displayer is mounted in the compressor unit to display information based on the determination result of the controller.

7. The liquid supply gas compressor according to claim 1, wherein the compressor body, the gas-liquid separator, and the liquid piping system form a compressor unit that is disposed on the same base, and the displayer is a communication terminal that is separated from the compressor unit to display information based on the determination result of the controller, the determination result being received via a communication line.

8. The liquid supply gas compressor according to claim 1, wherein the liquid piping system includes a heat exchanger that cools the liquid in the system, and the sensor is disposed upstream of or downstream of the heat exchanger.

9. A liquid supply gas compressor comprising:

a compressor body that compresses a gas while injecting a liquid into a compression chamber;

a gas-liquid separator that separates the liquid from the compressed gas, which is discharged from the compressor body, to store the liquid;

a liquid piping system that supplies the liquid, which is stored in the gas-liquid separator, to the compressor body;

an internal pipe that communicates with the liquid piping system, includes at least two hole portions of which disposition positions are different from each other in a height direction, and is disposed inside the gas-liquid separator;

a sensor that detects a pressure or a temperature of a fluid flowing through the liquid piping system;

a controller that calculates a change rate of the pressure or the temperature detected by the sensor, and generates a determination result by performing at least one of a determination as to whether or not the change rate is more than a positive set value set in advance and a determination as to whether or not the change rate is less than a negative set value set in advance, to determine which one of the gas and the liquid is the fluid flowing through the liquid piping system; and a displayer that notifies a determination result of the control device.

10. The liquid supply gas compressor according to claim 9, wherein in the hole portions, a diameter area of one hole portion located at a high position is less than or equal to a diameter area of the other hole portion located at a low position.

11. The liquid supply gas compressor according to claim 9, wherein the one hole portion located at the high position is open in a horizontal direction of the gas-liquid separator, and the other hole portion located at the low position is open to a vertical direction side with respect to an opening direction of the one hole portion.

12. The liquid supply gas compressor according to claim 9, wherein the controller calculates the change rate of the pressure or the temperature detected by the sensor, and performs both the determination as to whether or not the change rate is more than the positive set value set in advance and the determination as to whether or not the change rate is less than the negative set value set in advance, to determine which one of the gas and the liquid is the fluid flowing through the liquid piping system.

13. The liquid supply gas compressor according to claim 9, further comprising:

at least one of an intake throttle valve which closes an intake side of the compressor body and a gas release valve which releases the gas from a discharge side of the compressor body, in order to switch the compressor body from a load operation to a no-load operation.

14. The liquid supply gas compressor according to claim 9, wherein the compressor body, the gas-liquid separator, and the liquid piping system form a compressor unit that is disposed on the same base, and the displayer is a display device that is mounted in the compressor unit to display information based on the determination result of the control device.

15. The liquid supply gas compressor according to claim 9, wherein the compressor body, the gas-liquid separator, and the liquid piping system form a compressor unit that is disposed on the same base, and the display is a communication terminal that is separated from the compressor unit to display information based on the determination result of the controller, the determination result being received via a communication line.

16. The liquid supply gas compressor according to claim 9, wherein the liquid piping system includes a heat exchanger that cools the liquid in the system, and the sensor is disposed downstream of the heat exchanger.

17. A gas-liquid separator comprising:

an inlet opening into which a gas-liquid mixture of compressed gas containing a gas and a liquid flows;

an internal space in which the compressed gas flowing from the inlet opening is separated into the gas and the liquid;

an outlet opening through which the liquid separated flows from the internal space to an outside, and an internal pipe that extends from the outlet opening to the internal space, and communicates with the internal space, wherein the internal pipe includes at least two hole portions, of which disposition positions are different from each other in a height direction, on an internal space side.

18. The gas-liquid separator according to claim 17, wherein in the hole portions, a diameter area of one hole portion located at a high position is less than or equal to a diameter area of the other hole portion located at a low position.

19. The gas-liquid separator according to claim 17, wherein the one hole portion located at the high position is open in a horizontal direction of the gas-liquid separator, and the other hole portion located at the low position is open to a vertical direction side with respect to an opening direction of the one hole portion.

* * * * *